United States Patent [19]

Sims et al.

[11] 4,286,406

[45] Sep. 1, 1981

[54] SPINNING TOP PINBALL-TYPE GAME

[75] Inventors: Larry A. Sims, Hermosa Beach; Gerald L. Lambert, Torrance; Raymond J. Gross, Culver City; Harold B. Collins, Santa Monica, all of Calif.

[73] Assignee: Mattel, Inc., Hawthorne, Calif.

[21] Appl. No.: 150,880

[22] Filed: May 19, 1980

Related U.S. Application Data

[62] Division of Ser. No. 965,972, Dec. 4, 1978, Pat. No. 4,248,426.

[51] Int. Cl.[3] ..... A63H 1/02

[52] U.S. Cl. ..... 46/72; 46/67

[58] Field of Search ..... 124/41 R, 42; 273/108; 46/67, 65, 70, 71, 72

[56] References Cited

U.S. PATENT DOCUMENTS

| | | | |
|---|---|---|---|
| 299,703 | 6/1884 | Volke | 46/67 |
| 832,960 | 10/1906 | Elbra | 46/67 |
| 2,971,288 | 2/1961 | Gill | 46/72 X |
| 3,269,055 | 8/1966 | Gordon | 46/72 X |
| 3,517,656 | 6/1970 | Darrell | 124/42 X |

FOREIGN PATENT DOCUMENTS

| | | | |
|---|---|---|---|
| 361584 | 10/1922 | Fed. Rep. of Germany | 46/67 |
| 3028 | of 1900 | United Kingdom | 273/108 |
| 6760 | of 1890 | United Kingdom | 273/108 |

*Primary Examiner*—Richard C. Pinkham
*Assistant Examiner*—Scott L. Brown
*Attorney, Agent, or Firm*—John G. Mesaros; Ronald Goldman; Max Shirk

[57] ABSTRACT

A top and spinning mechanism, the top having an enlarged body portion and a stub base portion with an irregular configuration for coacting with a sleeve member of a top spinning mechanism, the sleeve member being configured for releasably receiving therein the stub base portion, rotation of the sleeve member rotating the top with a release lever on the top spinning mechanism manually operable for axially sliding the sleeve out of engagement with the base portion with the release lever having an arm member contacting the body of the top for directing the top onto a playing surface.

7 Claims, 14 Drawing Figures

FIG. 2
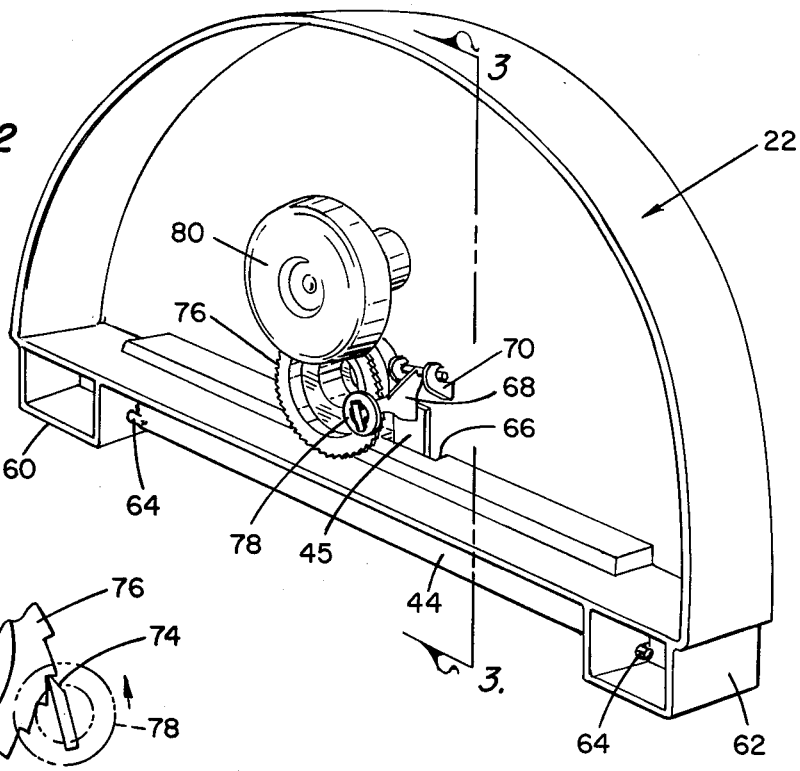
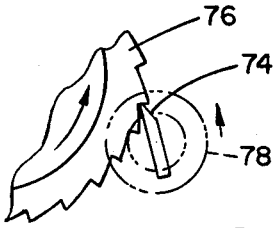
FIG. 4
FIG. 3
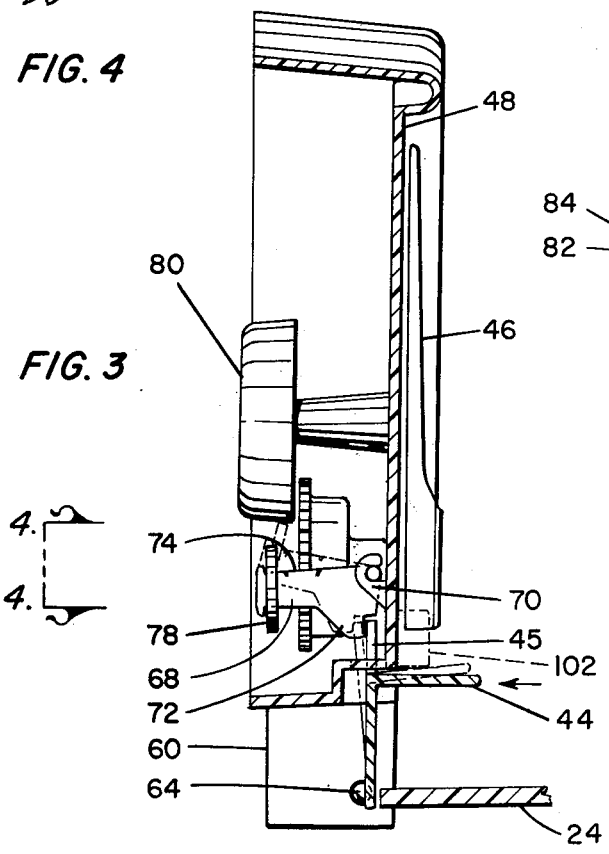
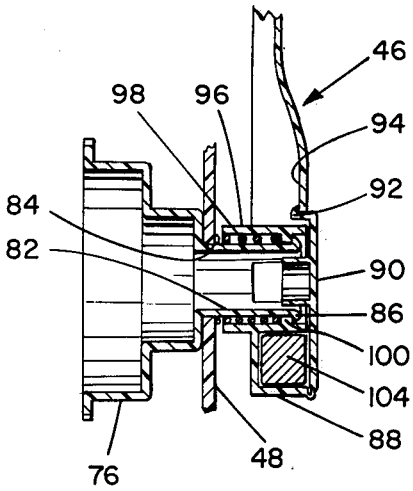
FIG. 5

FIG. 10
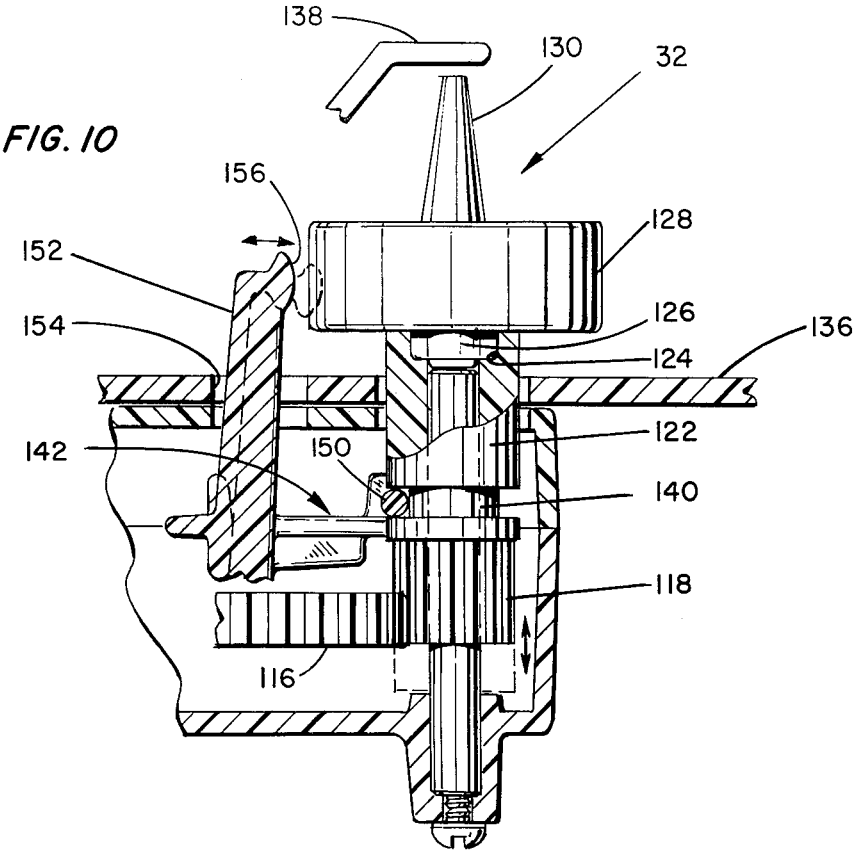
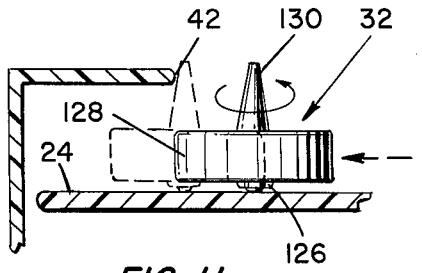
FIG. 11
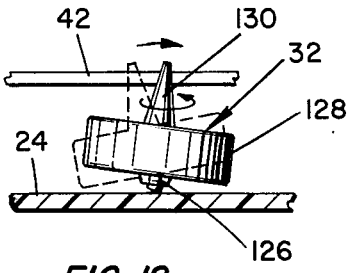
FIG. 12
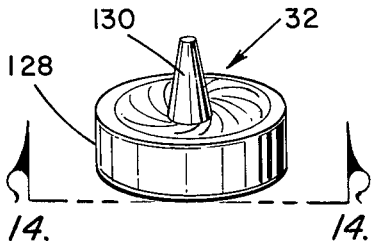
FIG. 13
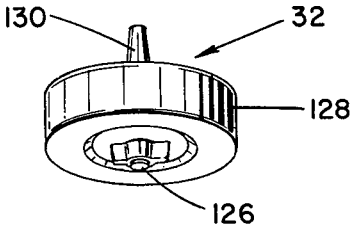
FIG. 14

SPINNING TOP PINBALL-TYPE GAME

This is a division, of application Ser. No. 965,972, filed Dec. 4, 1978 now U.S. Pat. No. 4,248,426.

BACKGROUND OF THE INVENTION

The background of the invention will be discussed in two parts:

1. Field of the Invention

This invention relates to a top and a top spinning mechanism.

2. Description of the Prior Art

Pinball-type games generally employ a playing surface having a plurality of obstacles designed for impact by the player controlled object, such as a pinball. The pinball may be of a conductive metal such as iron or steel of heavyweight, impact of the ball with various obstacles usually generating a score.

Games have been developed utilizing spinning tops which are propelled along a playing surface for impact with one or more obstacles, or with other spinning tops, such games being shown and described, for example, in U.S. Pat. Nos. 2,252,451; 2,627,412; and 3,712,619. In the aforementioned Patents, a top spinning device is provided for accelerating the top for propulsion along a playing surface which may have movable obstacles which are struck by the top, the number of obstacles so struck providing the scoring.

It is an object of the present invention to provide a new and improved top and top spinning mechanism.

SUMMARY OF THE INVENTION

The foregoing and other objects of the invention are accomplished by providing a top having an enlarged body portion and a stub base portion with an irregular configuration about the periphery thereof. A top spinning mechanism is provided for releasably receiving the top therein, the top spinning mechanism having a sleeve member with an aperture keyed for receiving the base portion of the top. A crank handle on the top spinning mechanism rotates the sleeve with a release lever being provided for sliding the sleeve out of engagement with the base portion of the top, the release lever having an arm member configured for contacting the body of the top upon movement of the sleeve member for directing the top onto a playing surface.

Other objects, features and advantages of the invention will become apparent from a reading of the specification when taken in conjunction with the drawings in which like reference numerals refer to like elements in the several views.

BRIEF DESCRIPTION OF THE DRAWINGS

FIG. 2 is a rear perspective view of the scoring portion of the apparatus of FIG. 1 as viewed generally along Line 2—2 thereof;

FIG. 3 is a cross sectional view of the game scoring apparatus of FIG. 2 as viewed generally along Line 3—3 thereof;

FIG. 4 is a partial view of the mechanism of FIG. 3 as viewed generally along Line 4—4 thereof;

FIG. 5 is a cross sectional view taken generally along Line 5—5 of FIG. 1;

FIG. 10 is an enlarged cross sectional view, partially broken away, of a portion of the top spinning module of FIG. 8 as viewed generally along Line 10—10 thereof;

FIGS. 11 and 12 are diagrammatic side elevational views showing the operative relationship between the spinning top and the playing surface;

FIG. 13 is a top perspective view of the top used in the game apparatus of FIG. 1; and FIG. 14 is a bottom perspective view of the top of FIG. 13 as viewed generally along Line 14—14 thereof.

DESCRIPTION OF THE PREFERRED EMBODIMENT

Figure 1:
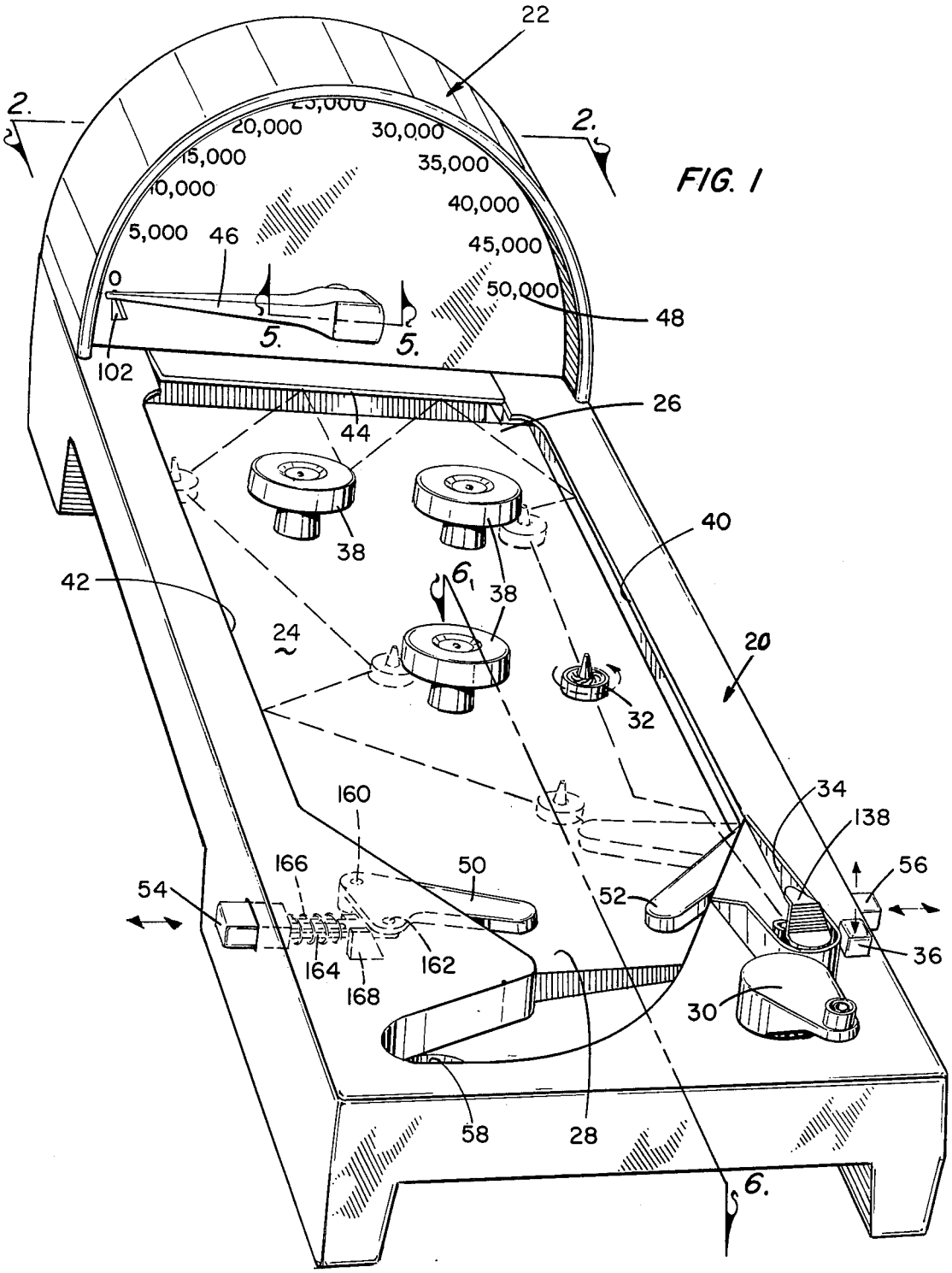
FIG. 1 is a perspective view of the spinning top pinball-type game apparatus according to the invention.

Referring now to the drawings and particularly to FIG. 1 there is shown a pinball-type game having a base housing generally designated 20 and a scoring mechanism housing generally designated 22 secured to one end of base housing 20 and extending generally perpendicular thereto. The base housing 20 is provided with a recessed playing surface 24 which is generally planar and formed or secured within base housing 20 so that the upper end 26 thereof is inclined or at a higher elevation than the lower end 28, the lower end 28 being at the end of the base housing 20 where the operator is positioned for play of the game.

Generally, the game includes a rotatable handle member 30 mounted above the plane of the base housing 20, rotation of the handle effecting high speed rotation of a game playing device such as a top 32 which is retained within a top spinning receptacle 34 and released onto the playing surface 24 by means of depressing a button 36. The receptacle 34 is positioned above the plane of the playing surface 24 and when the top 32 is propelled onto the playing surface 24 the top may collide with one of the stationary obstacles 38 or with one of the side rails 40 and 42 of the base housing 20 and may likewise collide with a rocker arm 44 pivotally coupled to the scoring mechanism housing 22 for actuating suitable indicating means such as a scoring dial 46 mounted for rotation relative to a score indicating surface 48, the angular rotation or pivoting of dial 46 being proportional to the impacts of the top 32 with the rocker arm 44 associated with the scoring mechanism to be hereinafter described. Each of the stationary obstacles 38 is generally mushroom-shaped and may include a bell or the like for producing a sound in response to impact with the top 32.

As the top 32 traverses the playing surface 24, the direction of travel of the top 32 will be determined by the initial direction with the direction being further determined by the particular obstacle impacted by the top 32, whether the obstacle be the stationary obstacles 38 or the side rails 40 and 42. As the top 32 traverses down the playing surface 24 toward the lower end 28, the game is provided with first and second flipper members 50 and 52 which are pivotally mounted within base housing 20 adjacent lower end 28 along opposite side rails 40 and 42 in symmetrical relation with each of the flipper members 50 and 52 being mechanically pivotable by means of flipper buttons 54 and 56 respectively positioned on opposite sides of the base housing 20. Depression of a flipper button 54 or 56 when the top 32 is in proximity to the flipper 50 or 52, upon impact, redirects the top 32 up the inclined playing surface 24 to prolong the play. The play is completed by the top 32 exhausting its inertia while on the playing surface 24 or by the top 32 bypassing the flippers 50 and 52 to be deposited in a return pocket 58.

By reference to FIGS. 2–5, the scoring mechanism wil be discussed in detail. The scoring mechanism housing 22 is semi-circular in form with a generally hollow reverse side with a pair of downwardly extending leg portions 60 and 62 adjacent opposite ends thereof with the rocker arm 44 pivotally mounted therebetween, the rocker arm 44 as best illustrated in FIG. 3 having a cross section which is generally kept L-shaped with the pivot axis 64 thereof adjacent a free end of one arm with the other arm thereof extending inwardly toward the playing surface 24, the pivot axis 64 being generally co-planar with the playing surface 24. The rocker arm 44 is provided with an upwardly extending tab portion 45 which extends into the rear compartment of the housing 22 through an enlarged opening 66. A pawl lever member 68 is mounted on the opposite surface of the score indicating surface 48 for pivotal movement relative thereto by means of pivoting bosses 70, the member 68 having a downward extending projection 72 abutting the tab portion 45 of rocker arm 44, pivoting of the rocker arm 44 in the direction of the arrow adjacent thereto causing clockwise pivoting of the member 68. As illustrated in FIG. 4, the pawl lever member 68 includes a generally bar shaped portion with a pawl edge 74 configured for engaging a ratchet gear 76 upon upward movement of the edge 74 to thereby rotate the ratchet gear 76 in a single direction, that is counterclockwise as viewed in FIG. 4. The pawl lever member 68 is mounted loosely relative to the bosses 70 and at a slight angle relative to the periphery of the ratchet gear 76 (see also FIG. 2) to enable the unidirectional movement of ratchet gear 76. The pawl lever member 68 is mounted at an angle relative to vertical, thus using the force of gravity to enable the pawl edge 74 to engage the ratchet gear 76 as well as return the lever member 68. Mounted loosely on the free end of the pawl lever member 68 is a metal member in the form of a washer 78 which impacts with a sounding mechanism such as a bell 80 when the force of the top 32 impacting on the rocker arm 44 is sufficient to pivot the pawl lever member 68 such that it accelerates washer 78 to the dotted line position indicated in FIG. 3.

As best illustrated in FIG. 5, the ratchet gear member 76 is provided with a shaft portion 82 which extends through an aperture 84 in the score indicating surface 48, the free end of shaft portion 82 being provided with a peripherally tanged edge 86. The dial pointer member 46 has a generally hollow base end 88 with a flexible hinged cover portion 90 having a tanged edge 92 configured for detenting engagement with the hollow opening 94 formed on the reverse side of the pointer member 46. The reverse side of the pointer member 46 is provided with a tubular portion 96 having an inner diameter greater than the outer diameter of the shaft portion 82 to provide a spaced opening therebetween for receiving a coil spring member 98 with one end thereof abutting against the score indicating surface 48 and the other end thereof urging against an inwardly extending shoulder 100 formed on the interior of the tubular portion 96. The spring 98 is keyed to shaft portion 82 by means of projections from ends of spring 98. The overall length of shaft portion 82 is sufficient to enable the tanged edge 86 to pass over the shoulder portion 100 for retaining the dial pointer member 46 on the shaft portion 82 with spring member 98 acting as a spring clutch for enabling the pointer member 46 to be rotated clockwise as viewed in FIG. 1 with this rotation being effected by movement of the ratchet gear member 76, while permitting the pointer member 46 to be manually rotated counterclockwise towards stop member 102 without corresponding rotation of the ratchet gear member 76. To further prevent the pointer member 46 from rotation under its own inertia, a counterweight 104 is fitted within the hollow opening 94 at a point opposite the long arm of the pointer member 46. During assembly, the ratchet gear member 76 has the shaft portion 82 thereof inserted through the aperture 84, the coil spring member 98 is positioned about the shaft portion 82, and with the cover portion 90 of the dial pointer member 46 opened, the tubular portion 96 is positioned about the spring 98 and pressed toward the surface 48 until the edge 86 of the shaft portion 82 detents with the shoulder portion 100. The counterweight 104 is then inserted into the opening 94 and the cover member 90 is rotated to close the opening with the tanged edge 92 thereof detenting within the opening. The cover member 90 is provided with an inwardly extending sleeve portion that projects into the interior of shaft portion 82 to lock the pointer member 46 to prevent removal thereof. In this manner, a resettable completely mechanical scoring mechanism results by utilization of a small number of components.

Referring now to FIGS. 6–10, the details pertaining to the top-spinning mechanism will now be discussed. The topspinning mechanism is provided in the form of a module which includes a housing generally designated 110 having rotatably mounted therein a main gear member 112 (see FIG. 9) directly coupled to the handle 30 with the teeth of the main gear member coacting wtih a first intermediate gear 114 which in turn coacts with a second intermediate gear 116 which in turn drives a pinion gear 118 on the output drive shaft 120, the gear ratios being selected to provide a high speed output on drive shaft 120, the ration being approximately 100:1. Mounted on output drive shaft 120 for axially slidable movement relative thereto is a sleeve member 122 having a keyed or slotted aperture 124 formed in the upper surface thereof for receiving the keyed base 126 of top 32 therein (see FIGS. 8 and 10). The top 32 generally includes a keyed smaller diameter base portion 126, an enlarged diameter cup-shaped body portion 128 and an upwardly extending stem portion 130 coaxial with the base portion 126. The bottom of the base portion 126 may be rounded or flat with the base portion being stub-shaped. The body portion 128 has the mass thereof positioned adjacent the periphery and the bottom to provide stability for operation at high speeds as well for withstanding the impact of the top 32 with the various obstacles 38 as well as the rocker arm 44. Likewise, the stem portion 130 is elongated and upwardly tapered, and as will hereinafter be discussed, the stem portion 130 is the portion of the top 32 which impacts with the various obstacles. The opened interior of the bottom portion 128 may optionally be filled with a plastic or encapsulation type material to provide a smooth upper contour for appearances.

Figure 6:
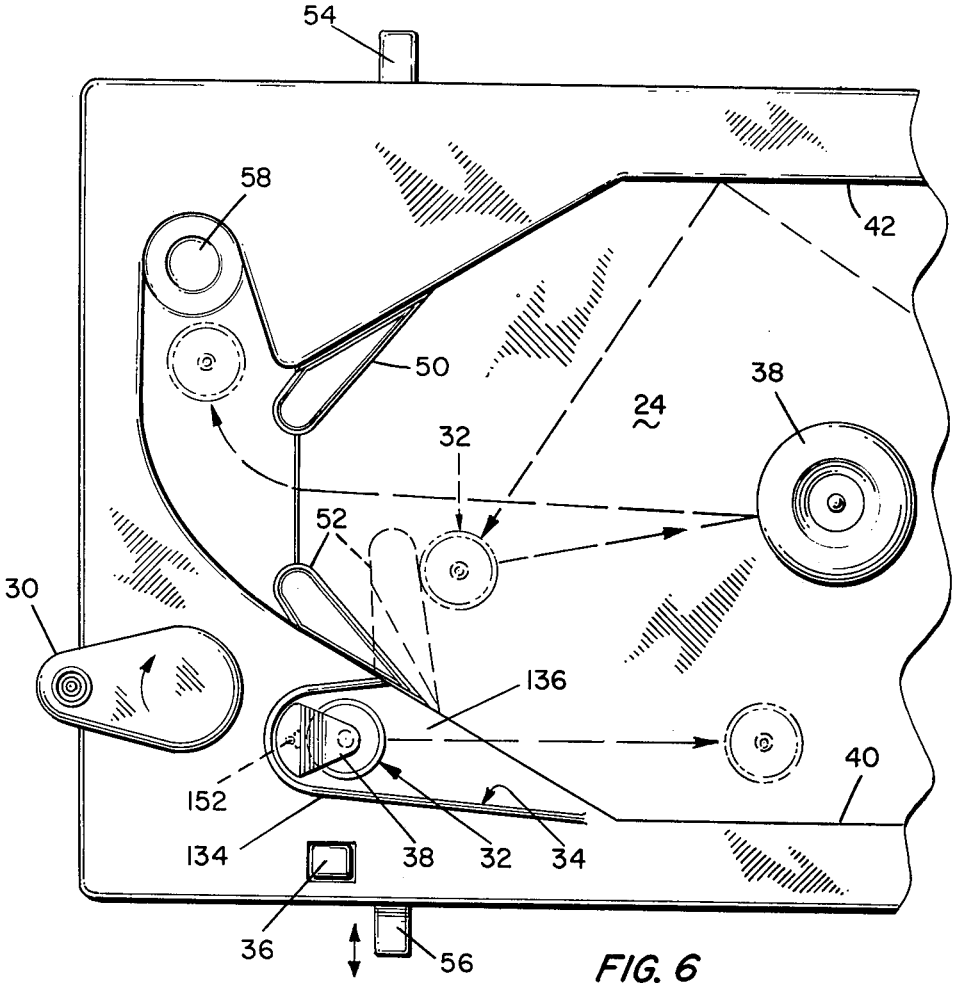
FIG. 6 is a partial plan view of the return end of the game apparatus of FIG. 1 as viewed generally along Line 6—6 thereof.
Figure 7:
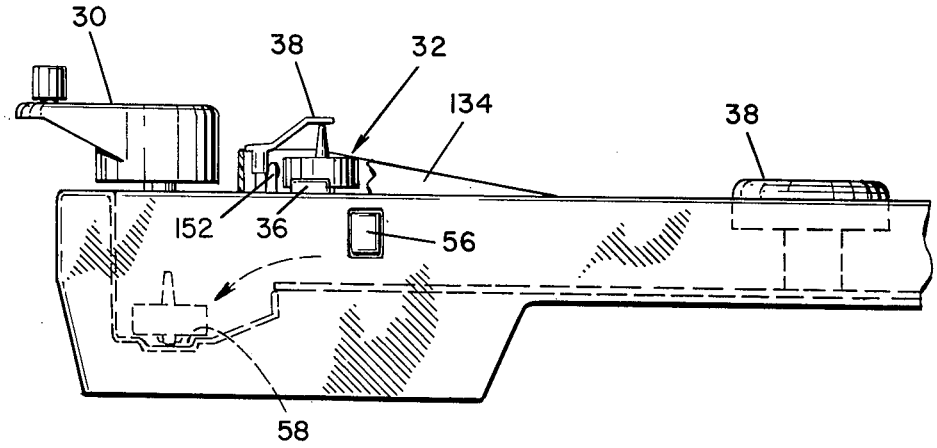
FIG. 7 is a side elevational view of the return end of the game apparatus depicted in FIG. 6.

Referring to FIG. 6, the top spinning receptacle 34 has a peripheral wall member 134 which is arcuately configured at one end adjacent the location of top 32 with the walls then running parallel to define an exit chute 136 elevated above the plane of the playing surface 24. Secured to the wall 134 adjacent the arcuate end thereof is an upwardly extending top stem retaining member 138, the free end of which is positioned directly above sleeve 122, the spacing of the projection 138 above the surface of chute 136 being sufficient to accomodate the top 32 with the keyed base portion 126 inserted within the keyed aperture 124 of the sleeve 122. The sleeve 122 is formed integrally with the pinion gear 118 with an integrally formed reduced diameter collar portion 140 therebetween, the entire assembly being axially slidable between the dotted line and solid line positions shown in FIG. 10, and with the sleeve 122 fully depressed, the upper surface thereof is generally coextensive with the surface of chute 136 for enabling release of the top 32.

Figure 8:
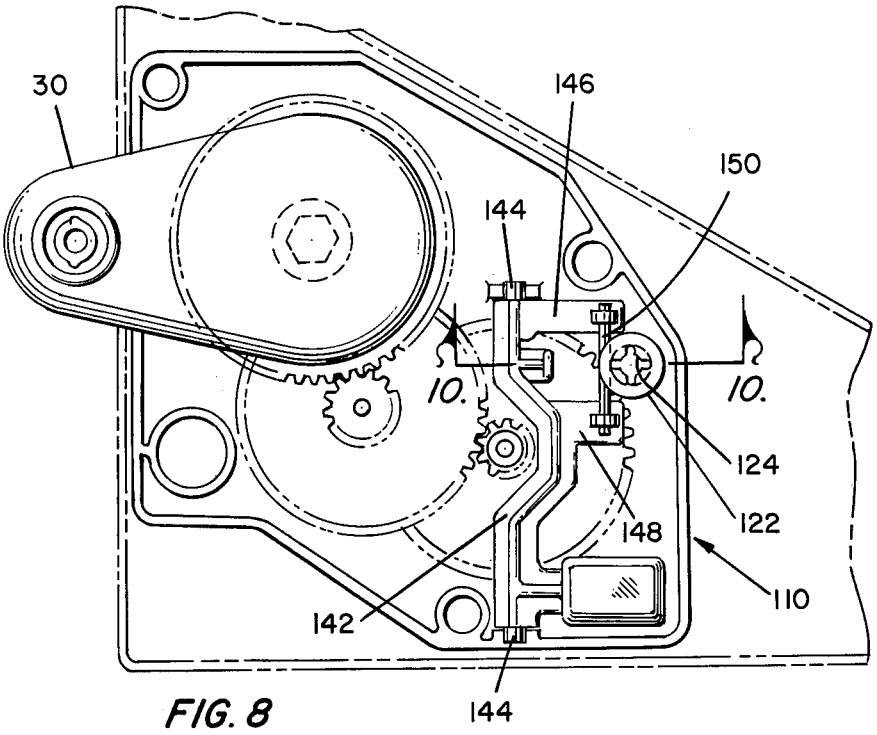
FIG. 8 is an enlarged plan view, partially in cross section and partially broken away depicting the top-spinning module used in the game apparatus of FIG. 1.
Figure 9:
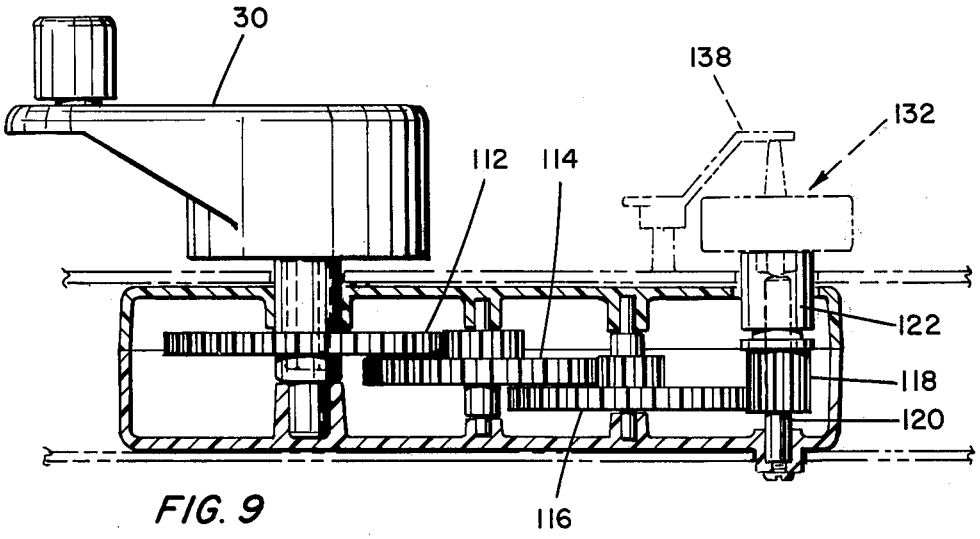
FIG. 9 is a side elevational view depicting the gearing arrangement within the top-spinning module of FIG. 8.

By reference to FIGS. 8 and 10, release of the top 32 is effected in the following manner. Pivotally mounted within the housing 110 is a top release member 142 having a pivot axis defined by pivot projections 144 fitting within journals formed in the bottom of the housing 110. The release member 142 is provided with a first integral arm having integrally configured therewith the release button 36 which extends up through the housing 110 for access above the upper plane of the base housing 20. The release member 142 is also provided with first and second generally parallel arms 146 and 148 which have the free ends thereof on either side of sleeve 122 with a rod member 150 interconnecting the arms 146 and 148, the rod member 150 being configured and positioned for fitting within the reduced diameter collar portion 140 of the sleeve member 122. Formed integrally with release member 142 and extending generally perpendicular to the plane of the arms 146 and 148 is a kicker arm 152 extending through a slot 154 for communicating with the interior of the top spinning receptacle 34. The kicker arm 152 is provided with an arcuately configured free end 156, the release member 142 being so configured and so dimensioned that the end 156 of kicker arm 152 in its normal position shown in solid lines in FIG. 10 is in spaced proximate relation to the periphery of the main body portion 128 of the top 32. The release member 142 is normally biased to the solid line position by means of a spring (not shown) disposed beneath the hollow button member 36 and the bottom surface of housing 110. The operation of the top spinning mechanism is as follows: The top 32 is inserted into the space between the upper edge of sleeve 122 and the lower surface of projection 138 by urging sleeve 122 downwardly with the base portion 126 of top 32 until the keyed base portion 126 is positioned within the keyed aperture 124 of the sleeve 122. The handle 30 is then rotated with a corresponding rotation of the pinion gear 118 at a much higher speed determined by the total gear ratio within the housing 110. By depression of the release or start button 36 downwardly, the release member 142 pivots clockwise as viewed in FIG. 10 with rod 150 coacting with the collar portion 140 urging the entire assembly of gear member 118 and sleeve member 122 downwardly to the dotted line position shown in FIG. 10. During this downward movement, the kicker arm 152 rotates clockwise to the dotted line position to thereby impact with the body portion 128 of the top 32 thereby kicking the top 32 outwardly along the exit chute 136 until the top 32 drops onto the playing surface 24.

With the top having the configuration previously described and shown in FIGS. 13 and 14, the movement of the top 32 upon reaching the playing surface 24 is depicted in FIGS. 11 and 12. In FIG. 11 the top 32 is shown in solid lines traveling in a direction toward the edge of the siderail 42, the top 32 rotating in a counterclockwise direction about the flat or semi-rounded bottom of base portion 126 on playing surface 24. With the siderail 42 having a cross-section in the form of an L-shaped member an opening is provided between the undersurface of siderail 42 and the playing surface 24 into which the enlarged base portion 128 may extend. At this point, the axis of rotation of top 32 as viwed in end view is vertical to the plane of the playing surface 24, although by reference to FIG. 12, the dotted line depiction of top 32 illustrates in side view that the axis of rotation of top 32 is tilted at an angle to the playing surface 24. The rotation of top 32 as well as action and reaction thereof is determined by an effect known as gyroscopic precession, with the top 32 acting as a gyroscope. In order to effect movement of the top 32, the axis of rotation thereof must be tilted relative to the playing surface 24, this tilt being depicted in dotted lines in FIG. 12. As the top 32 contacts the siderail 42 (as shown in dotted lines in FIG. 11) the axis of rotation thereof as viewed in end view in FIG. 11 still remains substantially vertical while tilting to the solid line position shown in FIG. 12 with the direction of travel thereafter being determined by this tilt. In the effect known as gyroscopic precession, the impact force on the top 32 will act in a direction 90° to the force in the direction of rotation. The small diameter of the stem 130 as well as the lowered center of gravity of the top 32 minimizes the transfer of energy upon impact thereby enabling the top 32 to maintain its rotation over a longer period of time. The rocker arm 44 of the scoring mechanism is configured so that the upper edge 30 thereof is generally co-planar with the upper edge of the siderails 40 and 42 so that impact of the top 32 with the rocker arm 44 would be by virtue of contact between the stem portion 130 and the edge of rocker arm 44 similar to the action depicted in FIG. 11. Similarly, the flipper members 50 and 52 are spaced relative to the playing surface 24 to provide impact with the stem portion 130 of the top 32 to assist in redirection of the top 32 in accordance with this gyroscopic effect.

By reference again to FIG. 1, with the top 32 traversing the playing surface as indicated by the dotted line travel, impact of the stem portion with an obstacle 38 would not generate a score but would provide an sudible signal. Impact thereafter with the first side rail 40 would redirect the top 32 toward the rocker arm 44 whereupon pivoting of the rocker arm 44 would increment the scoring dial pointer 46 clockwise an amount determined by the incremental movement of the ratchet gear 76. Subsequently, as the top 32 impacts the second obstacle 38 an audible signal would be emitted with subsequent impact with the rocker arm 44 again incrementing the pointer 46. As the top 32 then commences down the inclined playing surface 24 impact of the stem portion thereof with the side rail 42 would redirect the direction of travel of the top 32 which, as it reaches the lowermost position adjacent lower end 28 can be redirected up the surface 24 provided the stem portion 130 thereof is in a position for contact by the flippr member 52 when manually pivoted by depressing flipper button 56. With reference to the flipper member 50, the member 50 is pivotally coupled within the housing 20 about a pivot point 160 with the flipper member 50 having an offset spaced aperture 162 configured for engaging the stub portion at the end of the flipper button 54 with a spring 164 encircling a shaft portion 166 formed integrally with the flipper button 54, the spring 164 having one end thereof abutting against a stationary member 168 within housing 20 and the other end urging against enlarged button 54 for biasing the button 54 outwardly. The flipper member mechanism is in the form of bell crank resiliently biased to a first position with depression of button 54 operating against the bias to pivot the flipper member 50 to cause impact with the top 32 and thereby redirect it up the playing surface 24. The spacing between the ends of the flipper members 50 and 52 permits the top 32 to "escape" the playing surface 24, the top 32 then passing down the recessed and inclined return pocket 58, thus ending play for that turn. As previously discussed, the pointer 46 can then be manually rotated to abut against stop projection 102 prior to the next player's turn.

With the top 32 thus configured and with the spinning mechanism enabling very high rotational speeds of 10,000–20,000 rpm, the game provides a pinball-type action by utilization of a spinning top as the playing piece. It is to be understood, however, that the scoring mechanism may be used independently of the top 32 as the projectile, and similarly, the top spinning mechanism may be employed in conjunction with playing surfaces other than a pinball-type playing surface. Furthermore, the configuration of the top may likewise be employed with top spinning mechanisms other than the type herein shown and described. While there has been shown and described a preferred embodiment it is to be understood that various other adaptations and modifications may be made within the spirit and scope of the invention.

What is claimed is:

1. In a toy, the combination comprising:

a top having an enlarged body portion, and a stub base portion with an irregular configuration about the periphery thereof; and top spinning means including a supporting structure, a shaft mounted within said supporting structure and having axially movable thereon a sleeve member having an aperture keyed for receiving the irregular base portion of said top, means for rotating said sleeve, and release lever means manually operable for sliding said sleeve out of engagement with the base portion of said top, said release lever means having an arm member configured for contacting the body of said top upon movement of said sleeve member for directing the top onto a playing surface.

2. The combination according to claim 1 wherein said top spinning means further includes a projection coupled to said supporting structure, said projection terminating above the uppermost portion of said top for assisting in retaining the top in said top spinning means.

3. The combination according to claim 2 wherein said top spinning means further includes handle means and gear means interconnecting said handle means and said sleeve member.

4. The combination according to claim 3 wherein said gear means have a gear ratio sufficient to rotate said sleeve member at a speed greater than said handle means.

5. The combination according to claim 4 wherein said release lever means is a manually operable lever member pivotally mounted within said supporting structure and said arm member is a portion thereof in normally spaced proximate relation to the body portion of said top, said release lever member having means coacting with said sleeve member for axially moving the same.

6. The combination according to claim 5 wherein the body portion of said top is generally cup-shaped with a large portion of the mass thereof adjacent the periphery.

7. The combination according to claim 6 wherein said sleeve member includes a pinion gear portion.

* * * * *